US009757734B1

(12) United States Patent
Stevens et al.

(10) Patent No.: US 9,757,734 B1
(45) Date of Patent: Sep. 12, 2017

(54) PORTABLE FEED MILL APPARATUS

(71) Applicants: Doug Stevens, Norfolk, NE (US); Scott Stevens, Norfolk, NE (US); Mark Penlerick, Wayne, NE (US); Dale Kumpf, Leigh, NE (US)

(72) Inventors: Doug Stevens, Norfolk, NE (US); Scott Stevens, Norfolk, NE (US); Mark Penlerick, Wayne, NE (US); Dale Kumpf, Leigh, NE (US)

(73) Assignee: GLOBAL EQUIPMENT COMPANY INC., Norfolk, NE (US)

( * ) Notice: Subject to any disclaimer, the term of this patent is extended or adjusted under 35 U.S.C. 154(b) by 0 days.

(21) Appl. No.: 14/865,934

(22) Filed: Sep. 25, 2015

(51) Int. Cl.
*B02C 21/02* (2006.01)
*B02C 23/38* (2006.01)

(52) U.S. Cl.
CPC ..... *B02C 21/02* (2013.01); *B02C 21/026* (2013.01); *B02C 23/38* (2013.01)

(58) Field of Classification Search
CPC ..... B02C 21/02; B02C 23/38; B02C 21/026
See application file for complete search history.

(56) References Cited

U.S. PATENT DOCUMENTS 309,729 A * 12/1884 Mumford et al. ..... B02C 21/02 209/317
1,586,169 A * 5/1926 Webb ..... A01B 39/18 171/122
2,418,728 A * 4/1947 Sanders ..... E21B 19/14 414/22.51
2,775,174 A * 12/1956 Everett ..... A01B 77/00 171/116
2,982,484 A * 5/1961 Stahr ..... B01F 13/0035 222/64
3,174,696 A * 3/1965 Hoffman, Jr. ..... B02C 4/286 241/224
3,636,784 A * 1/1972 Sanstrom ..... B62D 11/08 180/6.2
3,670,972 A * 6/1972 Quinn ..... B02C 21/02 241/101.76
3,741,487 A * 6/1973 Kanengieter ..... B02C 23/00 241/101.76
3,749,035 A * 7/1973 Cayton ..... A01C 7/205 111/137
RE28,125 E * 8/1974 Quinn ..... B02C 21/02 241/101.76
3,964,716 A * 6/1976 McCorkle ..... B02C 21/02 241/152.2
3,964,719 A * 6/1976 Hally ..... A01B 77/00 241/101.763

FOREIGN PATENT DOCUMENTS

JP H 0924 9306 * 9/1997 ..... B65G 21/06

OTHER PUBLICATIONS

Yamagata (JPH 0924 9306)_translated version, Sep. 1997.*

* cited by examiner

*Primary Examiner* — Faye Francis
*Assistant Examiner* — Joseph Finan, Jr.
(74) *Attorney, Agent, or Firm* — Dennis L. Thomte; Thomte Patent Law Office LLC

(57) ABSTRACT

A portable feed mill machine having a plurality of spaced-apart feed mills positioned on a wheeled frame such as a trailer. Any one of the feed mills may be taken out of operation for repair without the other feed mills being taken out of operation. The machine may have a plurality of mechanized devices rather than the feed mills.

2 Claims, 6 Drawing Sheets

PORTABLE FEED MILL APPARATUS

BACKGROUND OF THE INVENTION

Field of the Invention

This invention relates to a portable feed mill apparatus and more particularly to a portable feed mill apparatus wherein a plurality of spaced-apart feed mills are positioned on a wheeled frame such as a trailer. Even more particularly, this invention relates to a portable feed mill apparatus wherein any one of the feed mills on the wheeled frame may be taken out of operation for repair without the other feed mills being taken out of operation.

Description of the Related Art

Feed mills such as roller mills have long been provided to grind feed such as corn, oats, etc., for feeding cattle, horses, etc. Further, in recent years, a plurality of spaced-apart feed mills have been positioned on a wheeled frame such as a trailer or truck. The feed mills on the wheeled frame are usually driven by the PTO of a tractor. The feed mills are driven in series by a drive shaft connected to the tractor PTO. However, if one of the feed mills must be repaired and taken out of operation, the other feed mills on the wheeled frame must be taken out of service while the feed mill to be repaired is out of service.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A portable feed mill apparatus is disclosed including a wheeled frame having a forward end, a rearward end, a first side and a second side. A first feed mill is mounted on the wheeled frame at the forward end thereof and a second feed mill is mounted on the wheeled frame rearwardly of the first feed mill. A third mill is mounted on the wheeled frame rearwardly of the second feed mill. Each of the feed mills have a feed hopper, with upper and lower ends, at the upper ends thereof which are configured to contain a feed constituent therein. Each of the feed mills have a rotatable mill positioned therein below the lower end of the feed hopper thereof. Each of the rotatable mills have a horizontally disposed mill drive shaft extending forwardly therefrom. Each of the mill drive shafts have a drive pulley fixedly secured thereto forwardly of the forward side thereof. A first bearing is mounted on the wheeled frame at the forward end thereof forwardly of the first feed mill and a second bearing is mounted on the wheeled frame rearwardly of the first bearing. A horizontally disposed and rotatable jackshaft, having forward and rearward ends, has its forward end mounted in the first bearing and its rearward end rotatably mounted in the second bearing. A jackshaft pulley is fixedly mounted on the jackshaft between the first and second bearings for rotation with the jackshaft. The forward end of the jackshaft is operatively connected to a rotational power source such as a PTO, motor or engine.

A third bearing is mounted on the wheeled frame at the first side thereof and which is positioned laterally outwardly of the jackshaft. A fourth bearing is mounted on the wheeled frame rearwardly of the third bearing. The first shaft extends rearwardly through the fourth bearing whereby the rearward end of the first shaft is positioned rearwardly of the fourth bearing. A first pulley is fixedly mounted on the first shaft between the third and fourth bearings and a first drive belt extends around the first pulley and the jackshaft pulley. A second pulley is fixedly mounted on the first shaft between the third and fourth bearings. A second drive belt extends around the second pulley and the drive pulley on the mill drive shaft of the first feed mill. A first universal joint is provided having forward and rearward ends with the forward end of the first universal joint being secured to the rearward end of the first shaft. A horizontally disposed and rotatable second shaft, having forward and rearward ends, has its forward end secured to the rearward end of the first universal joint. The apparatus also includes a second universal joint having forward and rearward ends with the forward end of the second universal joint being secured to the rearward end of the second shaft. A fifth bearing is secured to the wheeled frame rearwardly of the second universal joint and a sixth bearing is secured to the wheeled frame rearwardly of the fifth bearing. The apparatus also includes a third horizontally and rotatable shaft having forward and rearward ends with the third shaft being rotatably mounted in the fifth and sixth bearings so that the forward end of the third shaft is positioned forwardly of the fifth bearing and so that the rearward end of the third shaft is positioned rearwardly of the sixth bearing. The forward end of the third shaft is secured to the rearward end of the second universal joint. A third pulley is fixedly mounted on the forward end of the third shaft forwardly of the fifth bearing. A third drive belt extends around the third pulley and the drive pulley on the mill drive shaft of the second feed mill.

The apparatus further includes a third universal joint having forward and rearward ends with the forward end of the third universal joint being secured to the rearward end of the third shaft. A fourth horizontally disposed and rotatable shaft has its forward end secured to the rearward end of the third universal joint. A fourth universal joint, having forward and rearward ends, has its forward end secured to the rearward end of the fourth shaft.

A seventh bearing is secured to the wheeled frame forwardly of the rearward end of the wheeled frame and an eighth bearing is secured to the wheeled frame rearwardly of the seventh bearing. A fifth horizontally disposed and rotatable shaft, having forward and rearward ends, has its rearward end rotatably mounted in the eighth bearing and which extends rearwardly therefrom and has its forward end rotatably extending forwardly through the seventh bearing so that the forward end of the fifth shaft is positioned forwardly of the seventh bearing. The forward end of the fifth shaft is secured to the rearward end of the fourth universal joint. A fourth pulley is fixedly secured to the forward end of the fifth shaft forwardly of the seventh bearing. A fourth drive belt extends around the fourth pulley and the drive pulley on the mill drive shaft of the third feed mill.

The third-eighth bearings are selectively slidably movable laterally with respect to the wheeled frame so that associated shafts and pulleys thereon may move inwardly to enable the drive belts associated therewith to be removed therefrom if one of the feed mills requires repair. The universal joints may also be separated from their respective shafts so that the drive belts associated therewith may be removed therefrom. The fact that the individual feed mills may be taken out of operation without affecting the operation of the other feed mills of the apparatus enables the other feed mills to continue operating even though one of the feed mills has been taken out of operation for repair or maintenance.

Preferably, some of the bearings have belt tensioning bolt assemblies associated therewith to aid in tensioning the drive belts associated therewith. In some cases, the belt tensioning bolt assemblies may not be needed.

A principal object of the invention is to provide an improved portable feed mill apparatus.

A further object of the invention is to provide a portable feed mill apparatus wherein one of the feed mills on the apparatus may be taken out of operation without affecting the operation of the other feed mills of the apparatus.

A further object of the invention is to provide a portable feed mill apparatus which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
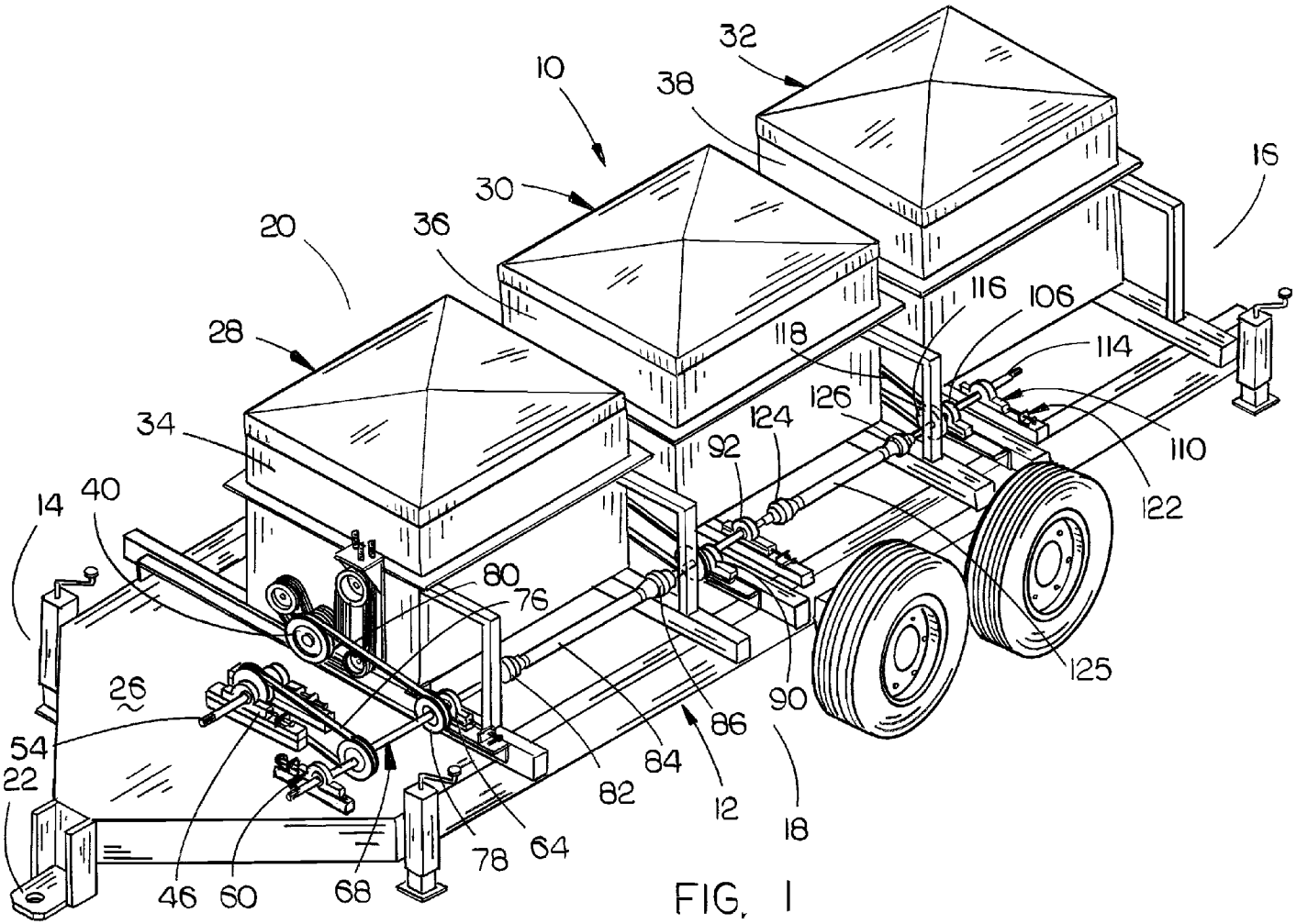
FIG. 1 is a front perspective view of the portable feed mill apparatus of this invention.
Figure 2:
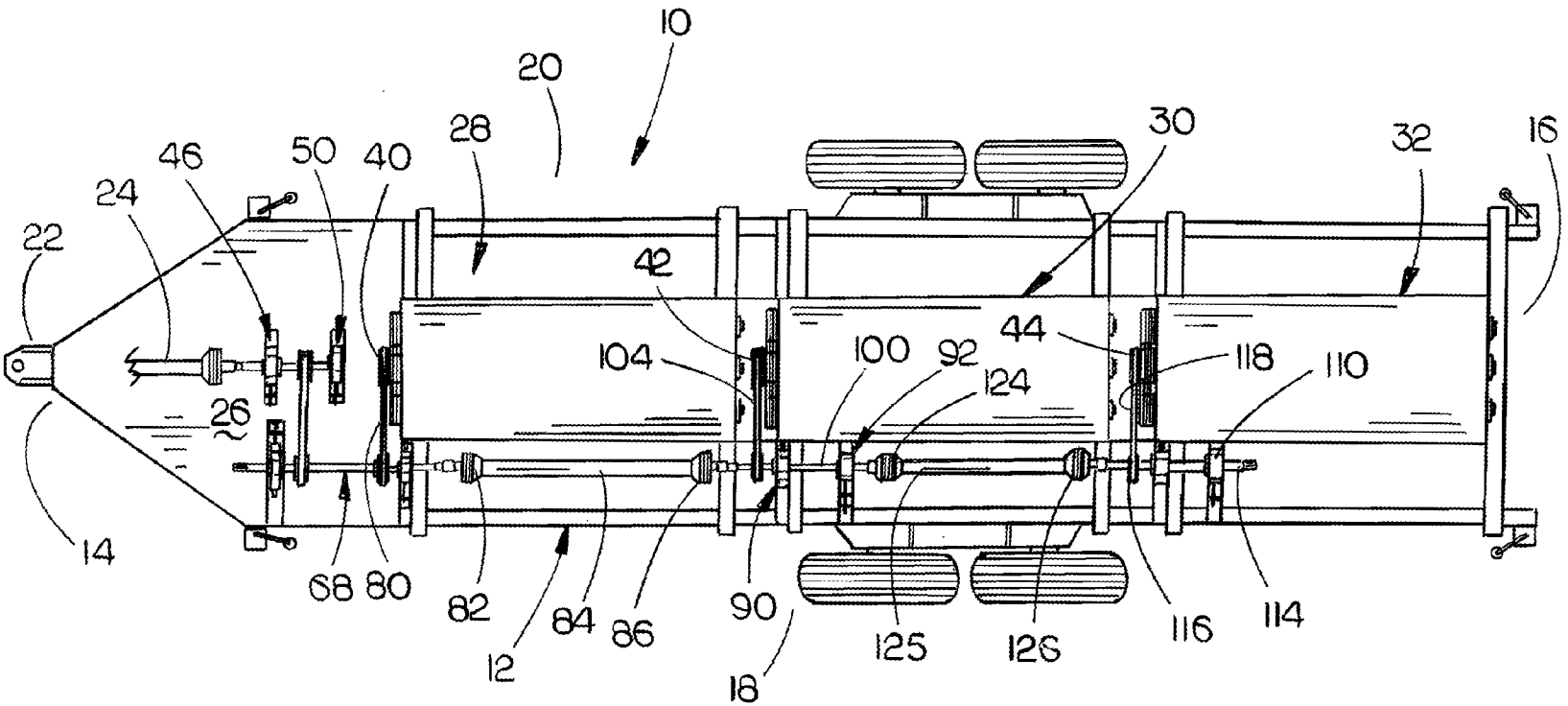
FIG. 2 is a top view of the portable feed mill apparatus of this invention.

The numeral 10 refers to the portable feed mill apparatus of this invention. Apparatus 10 includes a wheeled frame 12 such as a tractor with the wheeled frame 12 having a forward end 14, a rearward end 16, a left side 18 and a right side 20. A hitch 22 is provided at the forward end of frame 12 for connection to a tractor or the like having a PTO shaft 24 extending rearwardly therefrom. A platform 26 is provided at the forward end of the wheeled frame 12. A first feed mill 28 is mounted on wheeled frame 12 as seen in FIG. 1. Spaced-apart feed mills 30 and 32 are also positioned on wheeled frame 12 as seen in FIG. 1. Feed mills 28, 30 and 32 have feed hoppers 34, 36, and 38 at their upper ends which are configured to contain feed constituents therein such as corn, oats, etc. A mill such as a roller mill is positioned in each of the feed mills below the hoppers thereof for grinding the feed therein. The ground feed is discharged from the lower ends of the feed mills. The feed mills 28, 30 and 32 have drive shafts extending forwardly from the roller mill therein upon which pulleys 40, 42 and 44 are mounted thereon respectively for rotation therewith.

A horizontally disposed and transversely extending first bearing 46 is mounted on platform 26 by bolts 47 and is selectively transversely slidably adjustable with respect to platform 26. A belt tensioning bolt assembly 48 is provided to selectively move bearing 46 towards the right side 20 of wheeled frame 12 when the bolts 47 have been loosened to permit the slidable movement of bearing 46. A horizontally disposed and transversely extending second bearing 50 is mounted on platform 26 by bolts 51 rearwardly of bearing 46 and is selectively transversely slidably adjustable with respect to platform 26. A belt tensioning bolt assembly 52 is provided to selectively move bearing 50 towards the right side 20 of wheeled frame 12 when the bolts 51 have been loosened to permit the slidable movement of bearing 50. A jackshaft 54 is rotatably mounted in bearings 46 and 50 so that its forward end is positioned forwardly of bearing 46 for connection to the PTO shaft 24 or to another source of rotational power such as an engine, a motor, etc. A jackshaft pulley 58 is mounted on shaft 54 between bearings 46 and 50 for rotation with shaft 54. Preferably the bearings 46 and 50 are pillow block bearings which are self-aligning.

Figure 3:
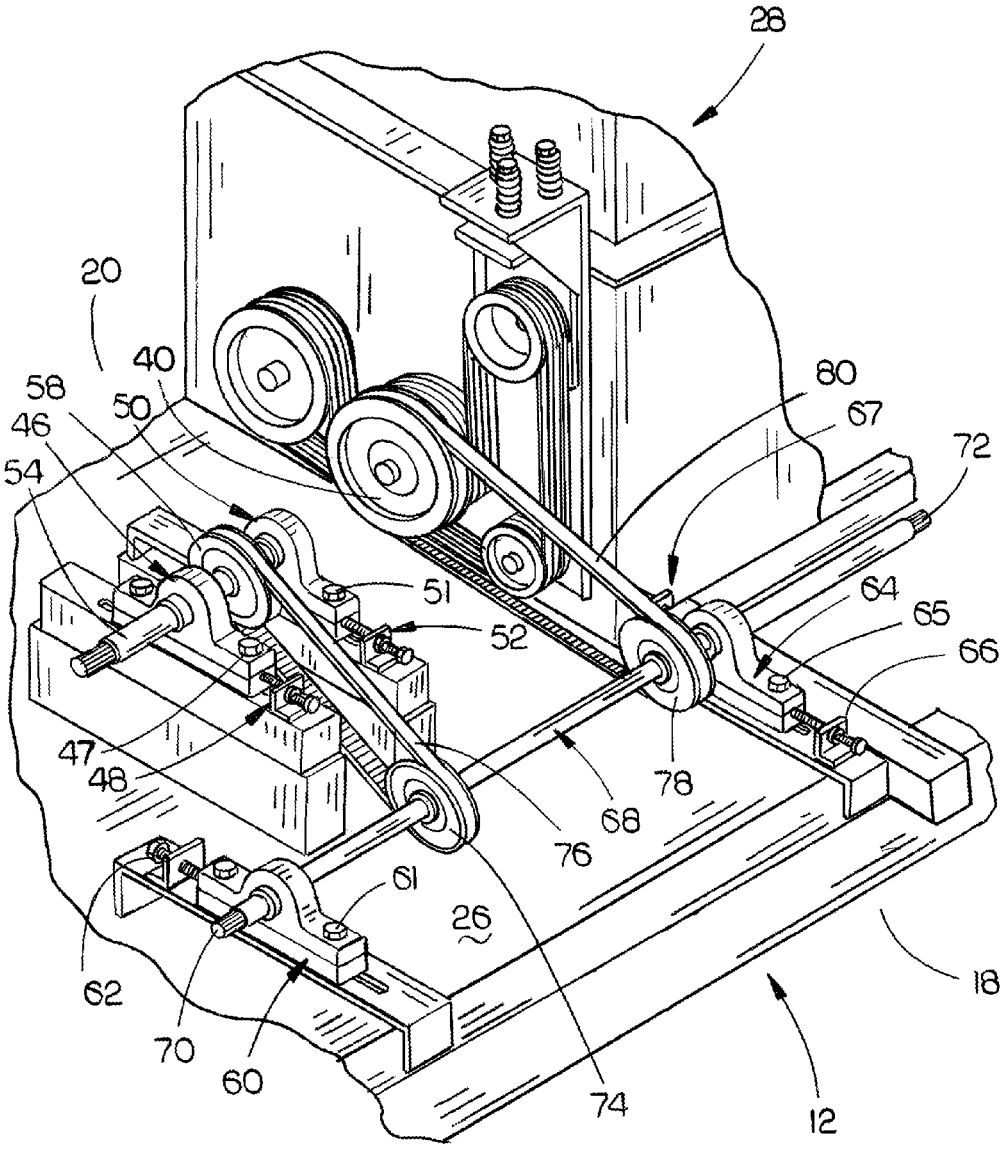
FIG. 3 is a partial perspective view of the front end of the portable feed mill apparatus of this invention.

The numeral 60 refers to a horizontally disposed and transversely extending third bearing which is mounted on platform 26 laterally outwardly of bearings 46 and 50 as seen in FIG. 3. Bearing 60 is selectively transversely slidably adjustable with respect to platform 26 by bolts 61. A belt tensioning bolt assembly 62 is provided to selectively move bearing 60 towards the left side 18 of wheeled frame 12 when the bolts 61 have been loosened to permit the slidable movement of bearing 60. A horizontally disposed and transversely extending fourth bearing 64 is secured to platform 26 rearwardly of bearing 60. Bearing 64 is selectively transversely slidably adjustable with respect to platform 26 by bolts 65. A belt tensioning bolt assembly 66 is provided to selectively move bearing 64 towards the right side 20 of wheeled frame 12 when the bolts 65 have been loosened to permit the slidable movement of bearing 64. A belt tensioning bolt assembly 67 is provided to selectively move bearing 64 towards the left side 18 of wheeled frame 12 when the bolts 65 have been loosened. An elongated first shaft 68, having a forward end 70 and a rearward end 72, is rotatably mounted in bearings 60 and 64 so that the rearward end 72 of shaft 68 is positioned rearwardly of bearing 64. A first pulley 74 is mounted on shaft 68 for rotation therewith. A first drive belt 76 extends around pulleys 74 and 58. A second pulley 78 is secured to shaft 68 for rotation therewith forwardly of bearing 64 as seen in FIG. 3. A second drive belt 80 extends around pulleys 78 and 40 as seen in FIG. 3.

The rearward end of jackshaft 54 will normally be extended rearwardly through bearing 46 so that jackshaft pulley 58 may be slipped onto jackshaft 54. One end of the belt 76 is then slipped onto the pulley. The rearward end of jackshaft 54 will then be extended into bearing 50. The jackshaft pulley 58 will then be secured to jackshaft 54 for rotation therewith.

The forward end 70 of shaft 68 will normally be extended forwardly through bearing 64 so that pulleys 74 and 78 may be slipped onto shaft 68. The outer ends of belts 76 and 80 will then be slipped onto the pulleys 74 and 78 respectively. The forward end 70 of shaft 68 is then positioned in bearing 60. The pulleys 74 and 78 will then be secured to shaft 68 for rotation therewith.

The proper tension will be imposed in belt 76 by belt tensioning bolt assemblies 48 and 52 being operated to urge bearings 46 and 50 towards the right side of the wheeled frame and by operating the belt tensioning bolt assembly 62 to urge bearing 60 towards the left side 18 of wheeled frame 12. The nuts on bolts 47, 51 and 61 will then be tightened. The proper tension in belt 80 will be achieved by way of the belt tensioning bolt assembly 67. When the belt 80 has been properly tensioned, the nuts on bolts 65 will then be tightened.

Figure 4:
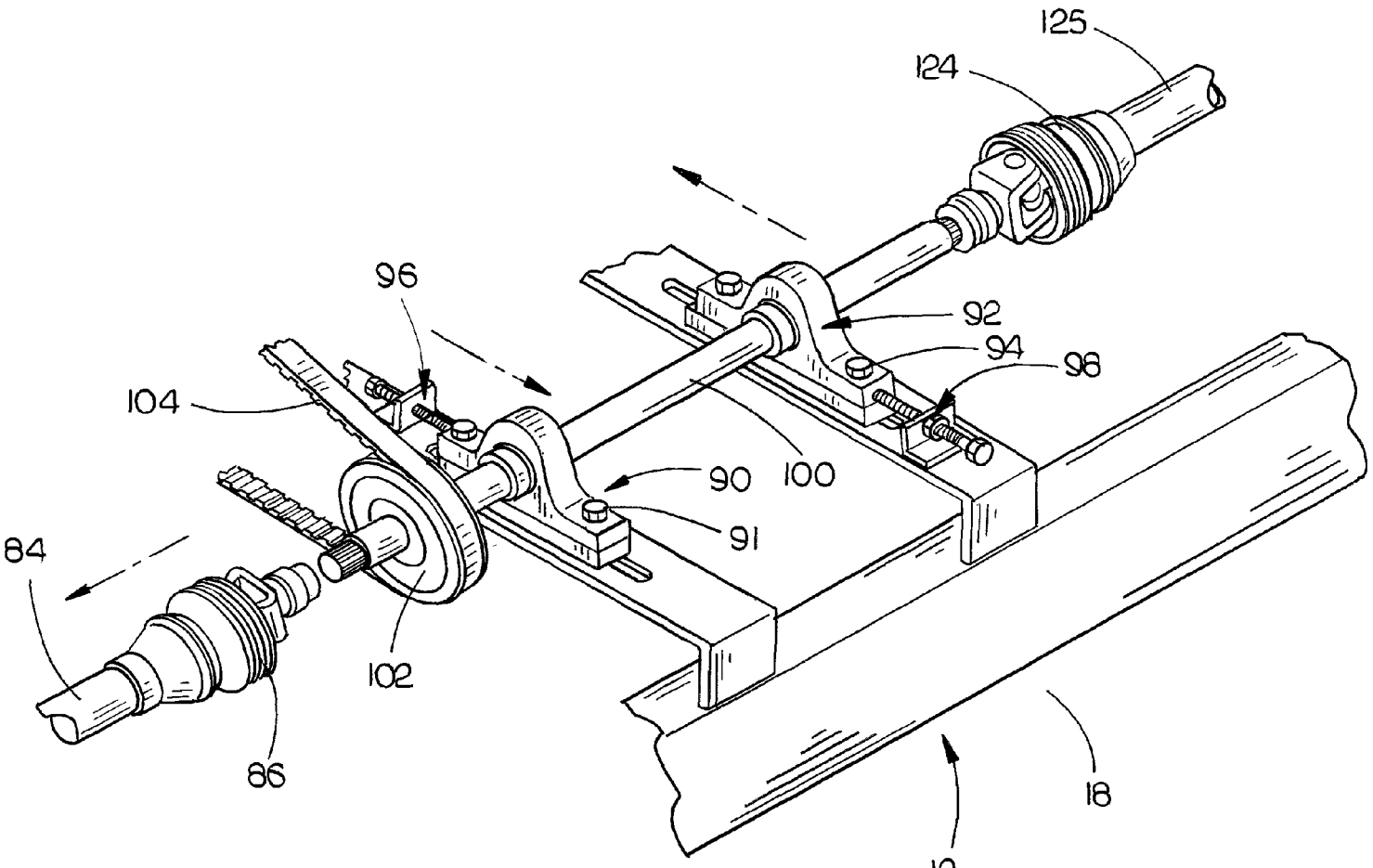
FIG. 4 is a partial perspective view of a portion of the portable feed mill apparatus of this invention.
Figure 5:
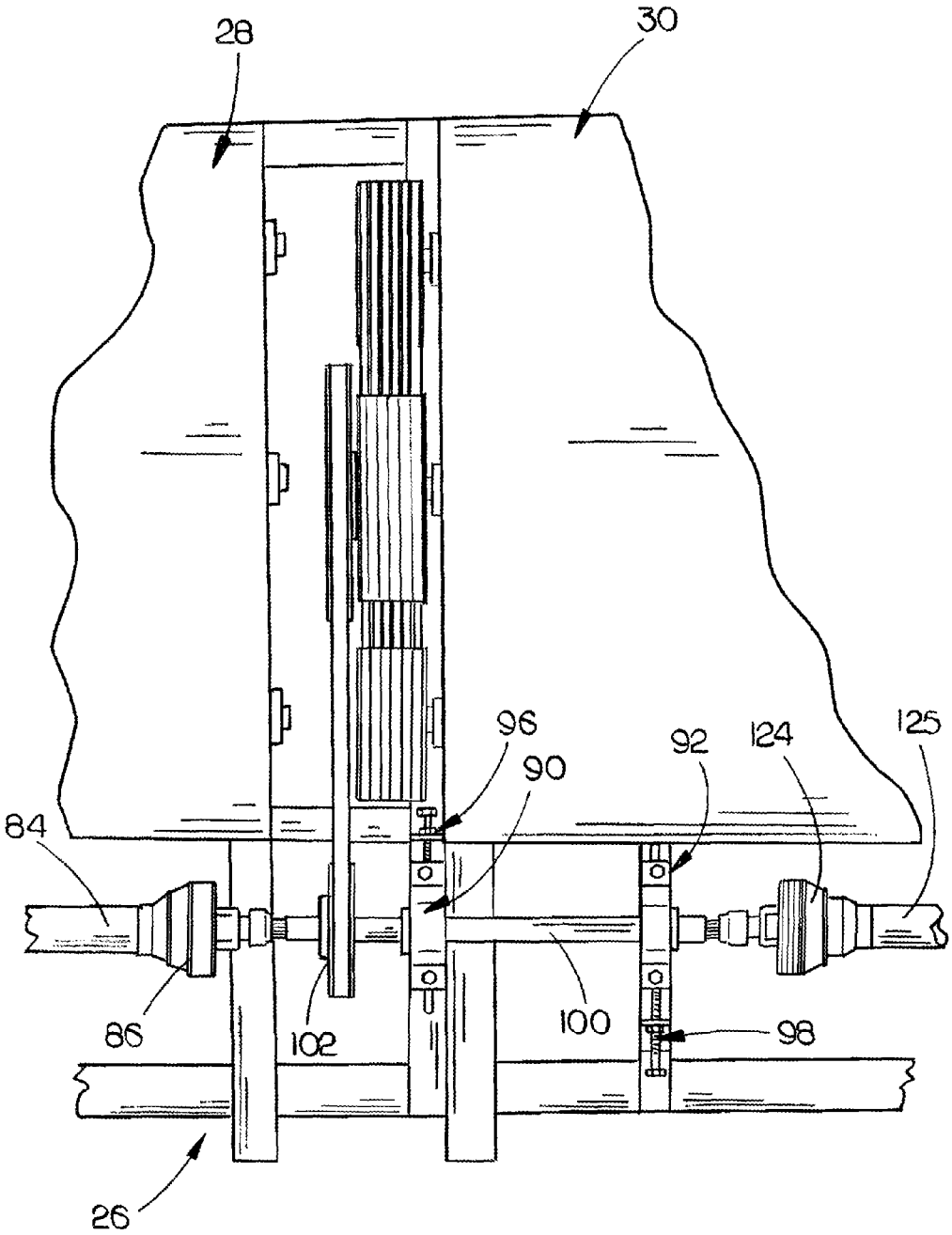
FIG. 5 is a partial top view of a portion of the portable feed mill apparatus of this invention.
Figure 6:
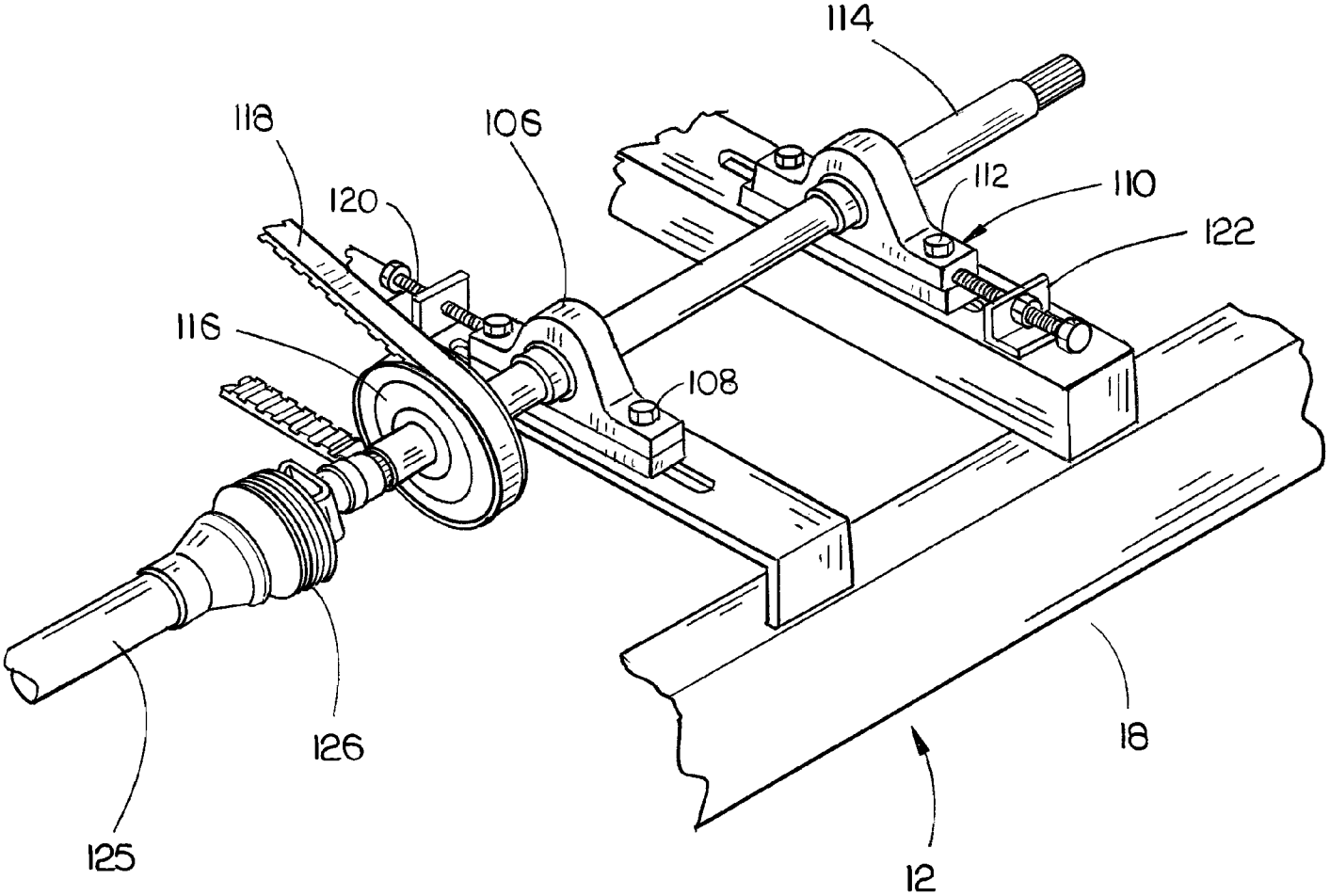
FIG. 6 is a partial perspective view of a portion of the portable feed mill apparatus of this invention.

The numeral 82 refers to a first universal joint which has its forward end or side selectively removably secured to the rearward end 72 of shaft 68. A second shaft 84 has its forward end secured to the rearward end of universal joint 82 and extends rearwardly therefrom. A second universal joint 86 has its forward end or side connected to the rearward end of shaft 84. A horizontally disposed and transversely extending fifth bearing 90 is transversely slidably secured to the wheeled frame 12 rearwardly of universal joint 86 by bolts 91 and a horizontally disposed and transversely extending sixth bearing 92 is secured to wheeled frame 12 rearwardly of bearing 88 by bolts 94. A belt tensioning bolt assembly 96 is provided to selectively move bearing 90 towards the left side 18 of wheeled frame 12 when the bolts 91 are loosened to permit the slidable movement of bearing 90. A belt tensioning bolt assembly 98 is provided to selectively move bearing 92 towards the right side 20 of wheeled frame 12 when the bolts 94 have been loosened. An elongated shaft 100 is rotatably mounted in bearings 90 and 92 so that its forward end is positioned forwardly of bearing 90 and so that its rearward end is positioned rearwardly of bearing 92. The forward end of shaft 100 is selectively removably secured to the rearward end of universal joint 86. A pulley 102 is mounted on shaft 100 for rotational movement therewith forwardly of bearing 90 as seen in FIG. 4. A drive belt 104 extends around pulley 102 and the pulley 42 on the drive shaft of feed mill 30. The movement of bearing 92 towards the right side of wheeled frame causes the forward end of shaft 100 to be moved towards the left side of wheeled frame.

The numeral 106 refers to an eighth bearing, which is identical to bearings 60, 64, 90 and 92, which is selectively transversely slidably mounted of wheeled frame 12 by means of bolts 108 rearwardly of bearing 92. The numeral 110 refers to a ninth bearing, which is identical to bearings 60, 64, 90 and 92, which is selectively transversely slidably mounted on wheeled frame 12 rearwardly of bearing 106 by bolts 112. A shaft 114 is rotatably mounted in bearings 106 and 110 so that its forward end is positioned forwardly of bearing 106 and so that its rearward end is positioned rearwardly of bearing 110. A pulley 116 is mounted on shaft 114 forwardly of bearing 106 for rotation with shaft 114. A belt 118 extends around pulley 116 and pulley 44 on mill 32. A belt tensioning bolt assembly 120 is provided to selectively slidably move bearing 106 towards the left side 18 of wheeled frame 12 when the bolts 108 are loosened. A belt tensioning bolt assembly 122 is provided to selectively slidably move bearing 110 towards the right side 20 of wheeled frame 12 when the bolts 112 are loosened.

A third U-joint 124 has its forward end or side selectively removably secured to the rearward end of shaft 100. A shaft 125 has its forward end secured to the rearward end of U-joint 124 and has its rearward end secured to the forward end of a fourth U-joint 126. The rearward end of U-joint 126 is selectively removably secured to the forward end of shaft 114.

In normal operation, the rotation of the jackshaft 54 by the PTO shaft 24 causes rotation of pulleys 40, 42 and 44 thereby rotating the mills in feed mills 28, 30 and 32 respectively. Assuming that mill 30 requires maintenance or repair, the operation of all the mills 28, 30 and 32 is temporarily halted. The belt tensioning bolt assembly 96 is then backed off and the nuts on bolts 91 of bearing 90 are loosened. The bearing 90 is then slidably moved towards the right side of wheeled frame 12 so that the tension in belt 104 is relaxed. If needed, bearing 92 may also be slidably moved towards the right side of the wheeled frame 12. The universal joint 86 is then disconnected from the forward end of shaft 100. The belt 104 may then be removed from pulley 102 and moved off the forward end of shaft 100 so that power to mill 30 is removed.

The universal joint 86 is then connected to the forward end of shaft 100 and the bearings 90 and 92 slidably moved towards the left side of wheeled frame 12 with the nuts on bolts 91 and 94 again tightened. The PTO shaft 24 is then rotated to power mills 28 and 32 during the time that mill 30 is repaired.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A portable feed mill apparatus, comprising:

a wheeled frame having a forward end, a rearward end, a first side and a second side;

a first feed mill mounted on said wheeled frame at the forward end thereof;

a second feed mill mounted on said wheeled frame rearwardly of said first feed mill and spaced rearwardly therefrom;

a third feed mill mounted on said wheeled frame rearwardly of said second feed mill and spaced rearwardly therefrom;

each of said feed mills having an upper end, a lower end, a forward side and a rearward side;

each of said feed mills having a feed hopper, with upper and lower ends, at its upper end which is configured to contain a feed constituent therein;

each of said feed mills having a rotatable roller mill positioned therein below said lower end of said feed hopper;

each of said rotatable roller mills having a horizontally disposed mill drive shaft extending forwardly therefrom;

each of said mill drive shafts having a drive pulley fixedly secured thereto forwardly of said forward side of the associated feed mill;

a first bearing mounted on said wheeled frame at the forward end thereof forwardly of said first feed mill;

a second bearing mounted on said wheeled frame rearwardly of said first bearing;

a horizontally disposed and rotatable jackshaft having forward and rearward ends;

said forward end of said jackshaft being rotatably mounted in said first bearing;

said rearward end of said jackshaft being rotatably mounted in said second bearing;

a jackshaft pulley fixedly mounted on said jackshaft between said first and second bearings for rotation with said jackshaft;

said forward end of said jackshaft being configured to be operatively connected to a rotational power source;

a third bearing mounted on said wheeled frame at said first side thereof and which is positioned laterally of said jackshaft;

a fourth bearing mounted on said wheeled frame rearwardly of said third bearing;

said fourth bearing being selectively laterally horizontally slidably adjustably secured to said wheeled frame;

a horizontally disposed and rotatable first shaft having forward and rearward ends;

said forward end of said first shaft being rotatably mounted in said third bearing;

said first shaft extending rearwardly through said fourth bearing whereby said rearward end of said first shaft is positioned rearwardly of said fourth bearing;

a first pulley fixedly mounted on said first shaft between said third and fourth bearings;

a first drive belt extending around said first pulley and said jackshaft pulley;

a second pulley fixedly mounted on said first shaft between said third and fourth bearings;

a second drive belt extending around said second pulley and the drive pulley on the mill drive shaft of said first feed mill;

a first universal joint having forward and rearward ends;

said forward end of said first universal joint being secured to said rearward end of said first shaft;

a horizontally disposed and rotatable second shaft having forward and rearward ends;

said rearward end of said first universal joint being secured to said forward end of said second shaft;

a second universal joint having forward and rearward ends;

said forward end of said second universal joint being secured to said rearward end of said second shaft;

a fifth bearing secured to said wheeled frame rearwardly of said forward rearward end of said second shaft;

said fifth bearing being selectively laterally horizontally slidably adjustably secured to said wheeled frame;

a sixth bearing secured to said wheeled frame rearwardly of said fifth bearing;

a horizontally disposed and rotatable third shaft having forward and rearward ends;

said third shaft being rotatably mounted in said fifth and sixth bearings so that said forward end of said third shaft is positioned forwardly of said fifth bearing and so that said rearward end of said third shaft is positioned rearwardly of said sixth bearing;

said forward end of said third shaft being secured to said rearward end of said second universal joint;

a third pulley fixedly mounted on said forward end of said third shaft forwardly of said fifth bearing;

a third drive belt extending around said third pulley and the drive pulley on the mill drive shaft of said second feed mill;

a third universal joint having forward and rearward ends;

said forward end of said third universal joint being secured to said rearward end of said third shaft;

a horizontally and rotatable fourth shaft having forward and rearward ends;

said forward end of said fourth shaft being secured to said rearward end of said third universal joint;

a fourth universal joint having forward and rearward ends;

said forward end of said fourth universal joint being secured to said rearward end of said fourth shaft;

a seventh bearing secured to said wheeled frame forwardly of said rearward end of said wheeled frame;

said seventh bearing being selectively laterally horizontally slidably adjustably secured to said wheeled frame;

an eighth bearing secured to said wheeled frame rearwardly of said seventh bearing;

a horizontally disposed and rotatable fifth shaft having forward and rearward ends;

said rearward end of said fifth shaft being rotatably mounted in said eighth bearing;

said forward end of said fifth shaft rotatably extending forwardly through said seventh bearing so that said forward end of said fifth shaft is positioned forwardly of said seventh bearing;

said forward end of said fifth shaft being secured to said rearward end of said fourth universal joint;

a fourth pulley fixedly secured to said forward end fifth shaft forwardly of said seventh bearing;

a fourth drive belt extending around said fourth pulley and the drive pulley on the mill drive shaft of said third feed mill;

said fourth bearing being selectively adjustably moved towards said first feed mill to loosen the tension in said second drive belt so that said second drive belt may be removed from said second pulley thereby taking said first mill out of operation without taking said second and third feed mills out of operation;

said fifth bearing being selectively adjustably moved towards said second feed mill to loosen the tension in said third drive belt so that said third drive belt may be removed from said third pulley thereby taking said second feed mill out of operation without taking said first and third feed mills out of operation; and said seventh bearing being selectively adjustably moved towards said third feed mill to loosen the tension in said fourth drive belt so that said fourth drive belt may be removed from said fourth pulley thereby taking said third feed mill out of operation without taking said first and second feed mills out of operation.

2. A portable feed mill apparatus, comprising:

a wheeled frame having a forward end, a rearward end, a first side and a second side;

a first feed mill mounted on said wheeled frame at the forward end thereof;

a second feed mill mounted on said wheeled frame rearwardly of said first feed mill and spaced rearwardly therefrom;

each of said feed mills having an upper end, a lower end, a forward side and a rearward side;

each of said feed mills having a feed hopper, with upper and lower ends, at its upper end which is configured to contain a feed constituent therein;

each of said feed mills having a rotatable mill positioned therein below said lower end of said feed hopper;

each of said rotatable mills having a horizontally disposed mill drive shaft extending forwardly therefrom;

each of said mill drive shafts having a drive pulley fixedly secured thereto forwardly of said forward side thereof;

a first bearing mounted on said wheeled frame at the forward end thereof forwardly of said first feed mill;

a second bearing mounted on said wheeled frame rearwardly of said first bearing;

a horizontally disposed and rotatable jackshaft having forward and rearward ends;

said forward end of said jackshaft being rotatably mounted in said first bearing;

said rearward end of said jackshaft being rotatably mounted in said second bearing;

a jackshaft pulley fixedly mounted on said jackshaft between said first and second bearings for rotation with said jackshaft;

said forward end of said jackshaft being operatively connected to a rotational power source;

a third bearing mounted on said wheeled frame at said first side thereof and which is positioned laterally of said jackshaft;

a fourth bearing mounted on said wheeled frame rearwardly of said third bearing;

said fourth bearing being selectively laterally horizontally slidably adjustably secured to said wheeled frame;

a horizontally disposed and rotatable first shaft having forward and rearward ends;

said forward end of said first shaft being rotatably mounted in said third bearing;

said first shaft extending rearwardly through said fourth bearing whereby said rearward end of said first shaft is positioned rearwardly of said fourth bearing;

a first pulley fixedly mounted on said first shaft between said third and fourth bearings;

a first drive belt extending around said first pulley and said jackshaft pulley;

a second pulley fixedly mounted on said first shaft between said third and fourth bearings;

a second drive belt extending around said second pulley and the drive pulley on the mill drive shaft of said first feed mill;

a first universal joint having forward and rearward ends;

said forward end of said first universal joint being secured to said rearward end of said first shaft;

a horizontally disposed and rotatable second shaft having forward and rearward ends;

said rearward end of said first universal joint being secured to said forward end of said second shaft;

said forward end of said second shaft being secured to said rearward end of said first universal joint;

a second universal joint having forward and rearward ends;

said forward end of said second universal joint being secured to said rearward end of said second shaft;

a fifth bearing secured to said wheeled frame rearwardly of said forward end of said second shaft;

said fifth bearing being selectively laterally horizontally slidably adjustably secured to said wheeled frame;

a sixth bearing secured to said wheeled frame rearwardly of said fifth bearing;

a horizontally disposed and rotatable third shaft having forward and rearward ends;

said third shaft being rotatably mounted in said fifth and sixth bearings so that said forward end of said third shaft is positioned forwardly of said fifth bearing and so that said rearward end of said third shaft is positioned rearwardly of said sixth bearing;

said forward end of said third shaft being secured to said rearward end of said second universal joint;

a third pulley fixedly mounted on said forward end of said third shaft forwardly of said fifth bearing; and a third drive belt extending around said third pulley and the drive pulley on the mill drive shaft of said second feed mill;

said fourth bearing being selectively adjustably moved towards said first feed mill to loosen the tension in said second drive belt so that said second drive belt may be removed from said second pulley thereby taking said first feed mill out of operation without taking said second feed mill out of operation; and said fifth bearing being selectively adjustably moved towards said second feed mill to loosen the tension in said third drive belt so that said third drive belt may be removed from said third pulley thereby taking said second feed mill out of operation without taking said first feed mill out of operation.

* * * * *